US010199734B2

(12) United States Patent
Eom et al.

(10) Patent No.: US 10,199,734 B2
(45) Date of Patent: Feb. 5, 2019

(54) ANTENNA FOR SATELLITE COMMUNICATION HAVING STRUCTURE FOR SWITCHING MULTIPLE BAND SIGNALS

(71) Applicant: INTELLIAN TECHNOLOGIES INC., Pyeongtaek-si, Gyeonggi-do (KR)

(72) Inventors: Kwangsik Eom, Seongnam-si (KR); Jeongwoo Park, Yongin-si (KR)

(73) Assignee: INTELLIAN TECHNOLOGIES INC., Gyeonggi-do (KR)

( * ) Notice: Subject to any disclaimer, the term of this patent is extended or adjusted under 35 U.S.C. 154(b) by 374 days.

(21) Appl. No.: 14/897,472

(22) PCT Filed: Jul. 18, 2013

(86) PCT No.: PCT/KR2013/006441
§ 371 (c)(1),
(2) Date: Dec. 10, 2015

(87) PCT Pub. No.: WO2015/002338
PCT Pub. Date: Jan. 8, 2015

(65) Prior Publication Data

US 2016/0141758 A1 May 19, 2016

(30) Foreign Application Priority Data

Jul. 3, 2013 (KR) ..... 10-2013-0077562

(51) Int. Cl.
*H01Q 19/19* (2006.01)
*H01Q 3/02* (2006.01)
(Continued)

(52) U.S. Cl.
CPC ..... *H01Q 13/02* (2013.01); *H01Q 1/12* (2013.01); *H01Q 3/18* (2013.01); *H01Q 3/20* (2013.01);
(Continued)

(58) Field of Classification Search
CPC H01Q 13/02; H01Q 1/12; H01Q 3/18; H01Q 3/20; H01Q 15/16; H01Q 16/132;
(Continued)

(56) References Cited

U.S. PATENT DOCUMENTS 3,394,378 A * 7/1968 Williams ..... H01Q 15/0033 343/779
5,130,718 A * 7/1992 Wu ..... H01Q 15/0033 343/781 CA
(Continued)

FOREIGN PATENT DOCUMENTS

JP 09294016 A 11/1997
WO WO-2011014919 A1 2/2011

OTHER PUBLICATIONS

International Search Report dated Apr. 2, 2014 for PCT Application No. PCT/KR2013/006441.

*Primary Examiner* — Dameon E Levi
*Assistant Examiner* — Jennifer F Hu
(74) *Attorney, Agent, or Firm* — Moser Taboada

(57) ABSTRACT

The present invention discloses an antenna for satellite communication having a structure for switching multiband signals. The antenna for satellite communication according to an embodiment of the present invention includes a main reflecting plate configured to be rotatable in a predetermined direction so as to be oriented in a direction in which a satellite is located, a first feed horn configured to be detachably installed in a region of an edge of the main reflecting plate, a sub-reflecting plate configured to be installed so as to be spaced apart from a reflecting surface of the main reflecting plate by a predetermined distance by at least one support means provided in a region of the main reflecting plate, and a second feed horn configured to be detachably installed on a side opposite to the reflecting surface of the
(Continued)

sub-reflecting plate, wherein an installation position of the sub-reflecting plate is changeable.

9 Claims, 5 Drawing Sheets

(51) Int. Cl.

| | |
|---|---|
| ***H01Q 13/02*** | (2006.01) |
| ***H01Q 1/12*** | (2006.01) |
| ***H01Q 15/16*** | (2006.01) |
| ***H01Q 3/18*** | (2006.01) |
| ***H01Q 3/20*** | (2006.01) |
| ***H01Q 19/13*** | (2006.01) |
| *H01Q 5/45* | (2015.01) |

(52) U.S. Cl.
CPC ..... *H01Q 15/16* (2013.01); *H01Q 19/132* (2013.01); *H01Q 19/192* (2013.01); *H01Q 3/02* (2013.01); *H01Q 5/45* (2015.01); *H01Q 19/193* (2013.01)

(58) Field of Classification Search
CPC .... H01Q 19/192; H01Q 19/132; H01Q 19/19; H01Q 19/191; H01Q 19/193
See application file for complete search history.

(56) References Cited

U.S. PATENT DOCUMENTS

| | | | | |
|---|---|---|---|---|
| 5,471,224 | A * | 11/1995 | Barkeshli | H01Q 19/195 343/909 |
| 5,485,168 | A * | 1/1996 | Parekh | H01Q 3/20 343/761 |
| 6,512,485 | B2 * | 1/2003 | Luly | H01Q 1/247 343/753 |
| 7,982,687 | B1 * | 7/2011 | Santoru | H01Q 19/195 343/776 |
| 9,281,561 | B2 * | 3/2016 | Monte | H01Q 3/18 |
| 2005/0110694 | A1 | 5/2005 | Webb et al. | |
| 2009/0224993 | A1 * | 9/2009 | Peichl | G01S 13/426 343/761 |
| 2014/0225796 | A1 * | 8/2014 | Chen | H01Q 15/0033 343/781 CA |

* cited by examiner

[Fig. 1]
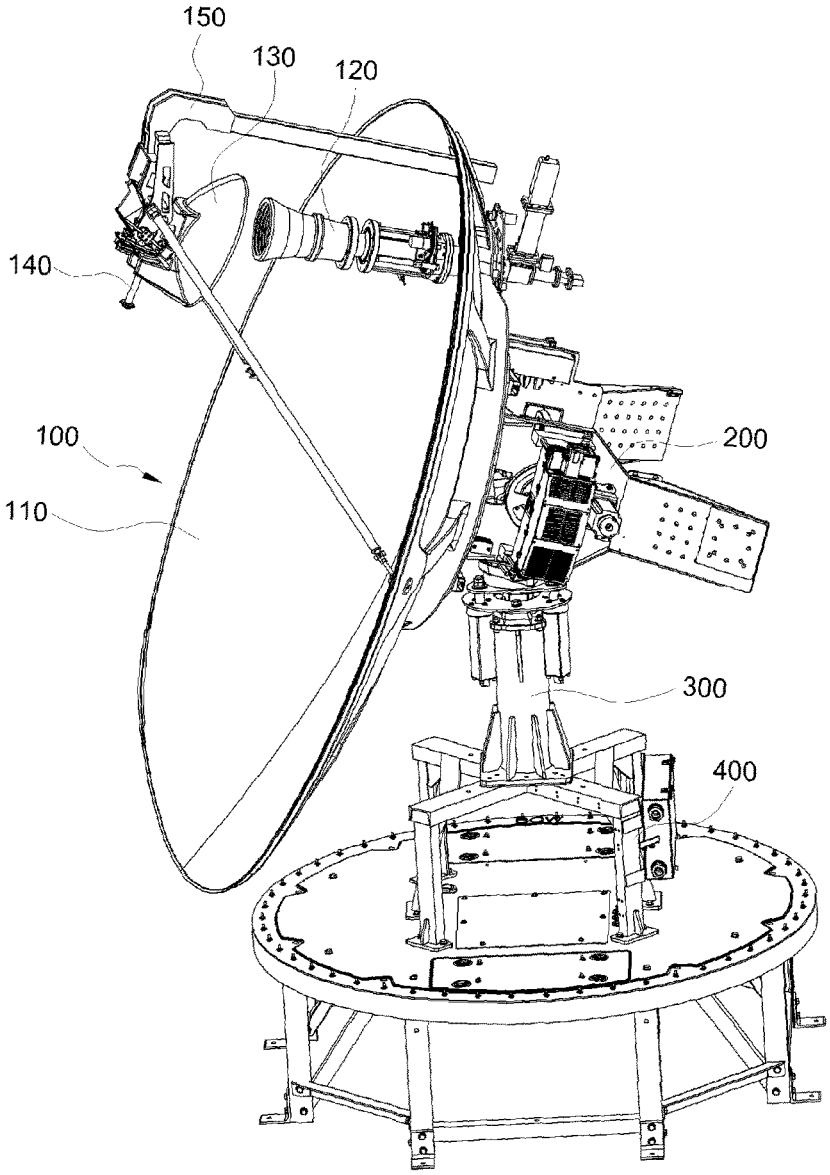

[Fig. 2]
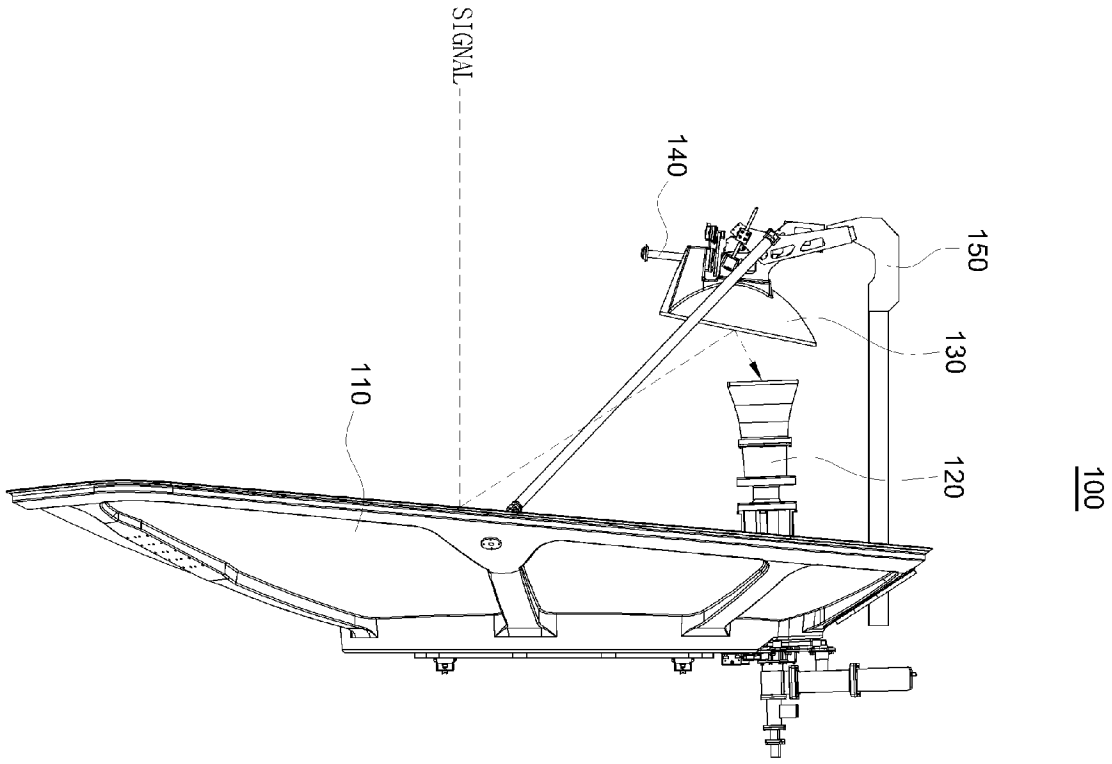

[Fig. 3]
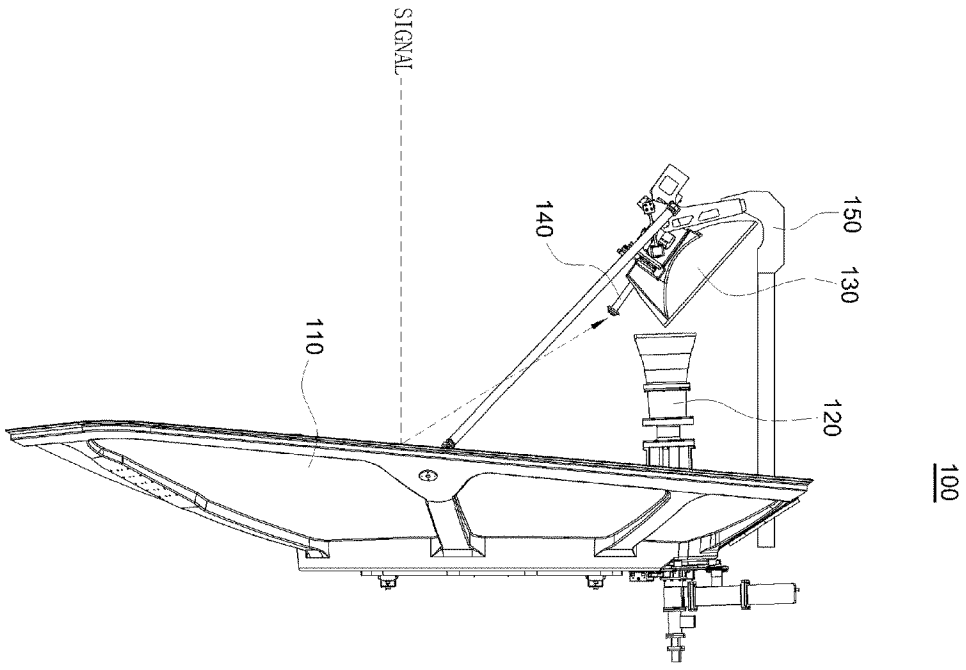
[Fig. 4]
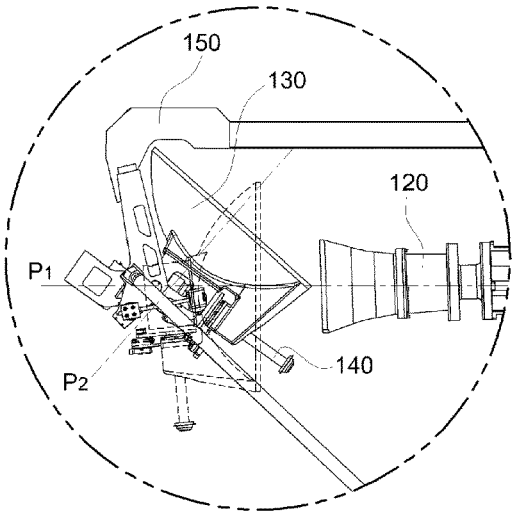

[Fig. 5]
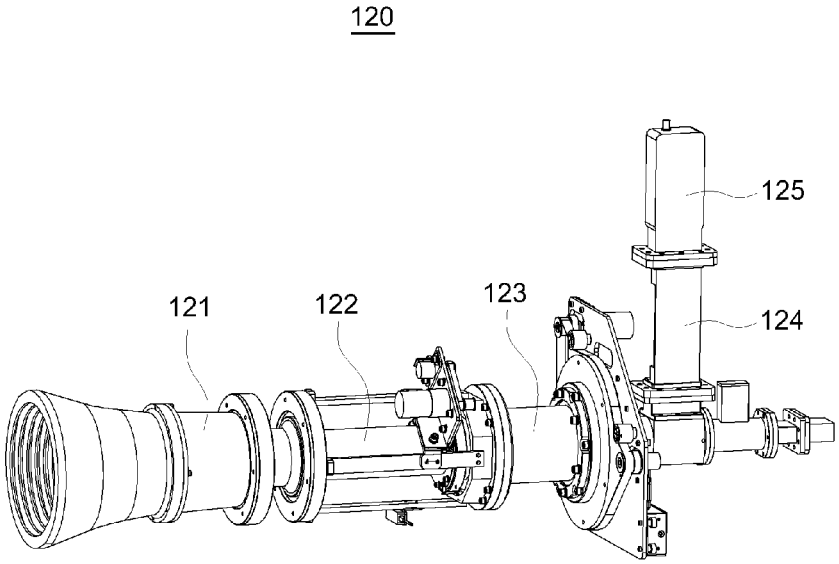
[Fig. 6]
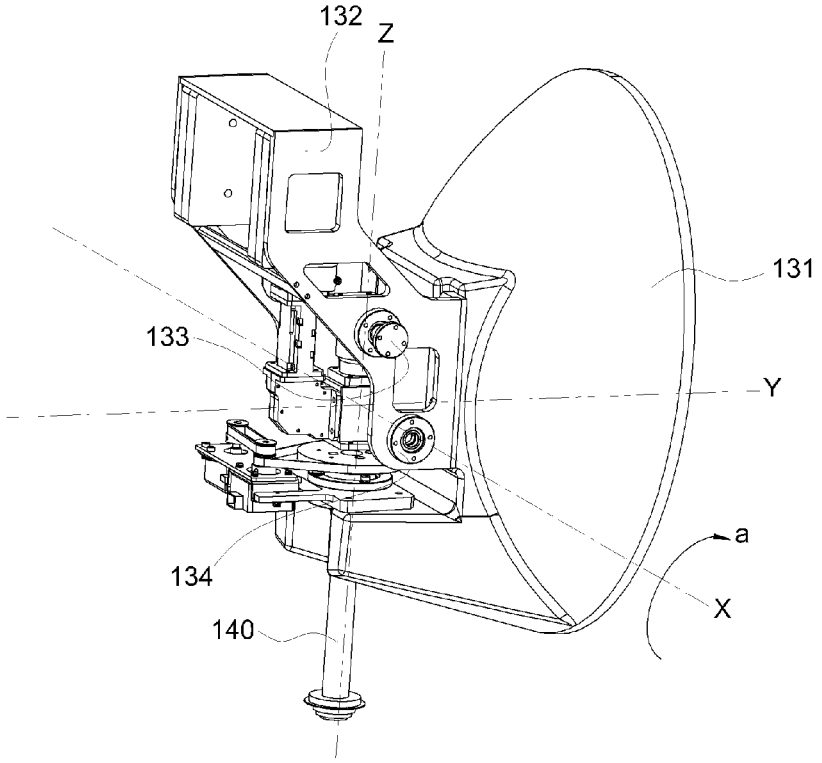

[Fig. 7]
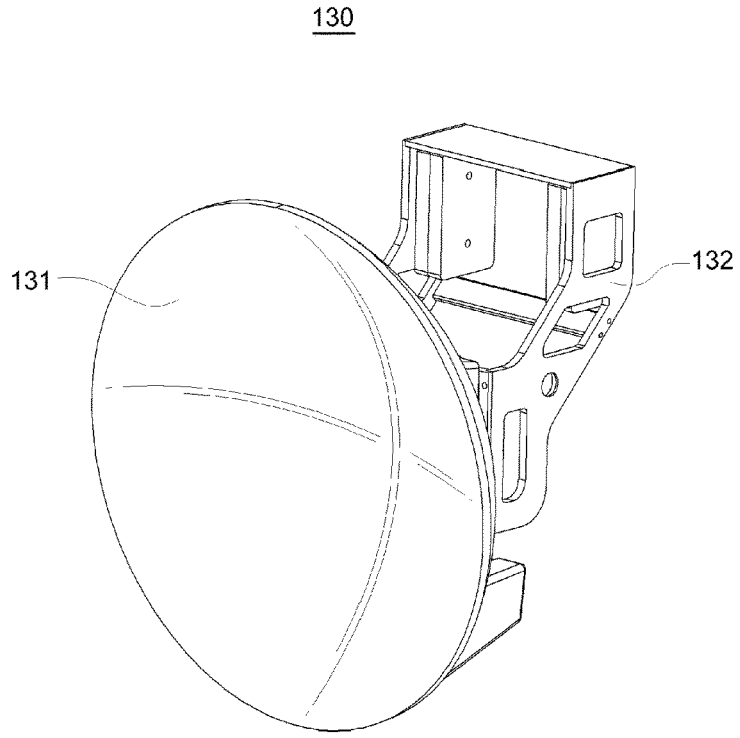
[Fig. 8]
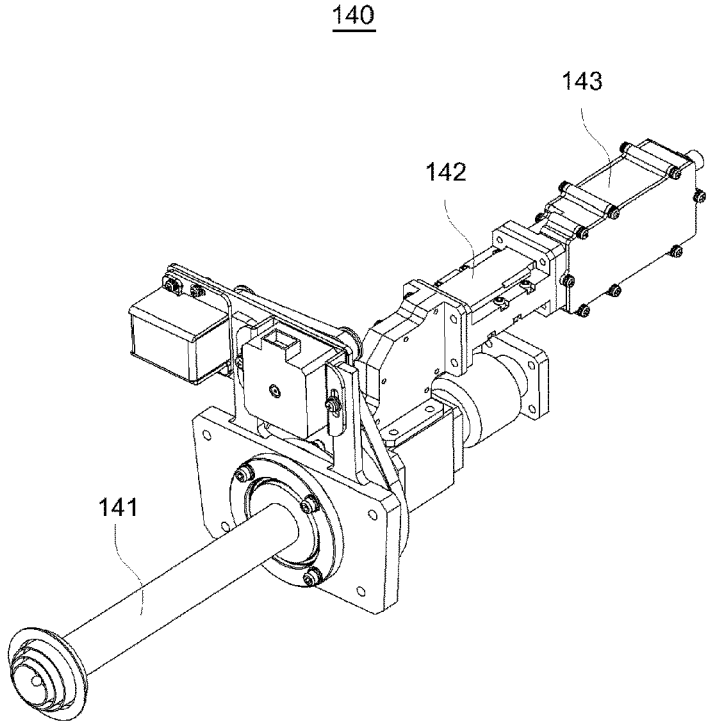

ANTENNA FOR SATELLITE COMMUNICATION HAVING STRUCTURE FOR SWITCHING MULTIPLE BAND SIGNALS

TECHNICAL FIELD

The present invention relates to an antenna for satellite communication, and more particularly, to an antenna for satellite communication having a structure for switching multiband signals which may automatically switch a satellite communication signal band.

BACKGROUND ART

In general, an antenna for satellite communication performs communication with a satellite using frequency signals (for example, first band signals, second band signals, and the like) of a specific band. The first band (for example, C band) signals are signals of a low frequency band of approximately 4 to 8 GHz. The second band (for example, Ku band) signals are signals of a high frequency band of approximately 10.95 to 14.8 GHz.

High frequency band communication has an economic advantage in that it enables miniaturization of satellites and earth stations, and low frequency band communication has an advantage in that it has excellent propagation characteristics.

There is a structural difference between a feed horn for first band communication and a feed horn for second band communication due to frequency characteristics.

In case of a single antenna for satellite communication, in order to use both the first band communication and the second band communication, both the feed horn for first band communication and the feed horn for second band communication should be provided.

Alternatively, in the single antenna for satellite communication, a method of replacing the feed horn for first band communication and the feed horn for second band communication may be considered. However, the method of replacing the feed horn is merely an example.

In order for workers to actually perform communication with specific band signals, the method of replacing the feed horn is accompanied with various inconveniences in the process. That is, since a user manually replaces the feed horn based on a manual, focuses of the feed horn and main reflecting plate may not be aligned correctly or inconvenience may be caused due to a complex re-assembly process.

Alternatively, a method of integrally designing a feed horn capable of performing communication with signals of a plurality of frequency bands may be considered. However, when a first band communication feed horn and a second band communication feed horn which are installed in a satellite antenna are integrally designed, weight of the feed horn becomes great and the structure thereof becomes complex.

DISCLOSURE OF INVENTION

Technical Problem

The present invention is directed to providing an antenna for satellite communication having a structure for switching multiband signals, which may automatically switch a communication signal band without replacement or reassembly of a plurality of feed horns.

Solution to Problem

One aspect of the present invention provides an antenna for satellite communication having a structure for switching multiband signals, which is installed in a mobile body, the antenna for satellite communication including: a main reflecting plate configured to be rotatable in a predetermined direction so as to detect a satellite signal; a sub-reflecting plate configured to be installed so as to be spaced apart from the main reflecting plate by a predetermined distance by at least one support means installed in an edge region of a reflecting surface of the main reflecting plate; a first feed horn configured to transmit a first band signal to a satellite through the main reflecting plate via the sub-reflecting plate or receive the first band signal from the satellite; and a second feed horn configured to be electrically separated from the sub-reflecting plate, form a structure integrated with the sub-reflecting plate, and transmit a second band signal to the satellite through the main reflecting plate or receive the second band signal from the satellite, wherein the structure in which the sub-reflecting plate and the second feed horn are integrated is movable so that the sub-reflecting plate or the second feed horn is oriented toward the main reflecting plate.

The antenna for satellite communication may further include a driving means configured to be driven in accordance with a control instruction of a user and drive the sub-reflecting plate or the second feed horn to be oriented toward the main reflecting plate.

The structure in which the sub-reflecting plate and the second feed horn are integrated may be separated into the sub-reflecting plate and the second feed horn, and an angle between a normal line direction of the reflecting surface of the sub-reflecting plate and a direction of a center axis of the second feed horn may be a predetermined angle.

The first feed horn may transmit or receive the first band signal as signals of at least one frequency band among a plurality of frequency bands available for satellite communication.

The first feed horn may be configured in a Gregorian type.

The first feed horn may be disposed in a region of the main reflecting plate, and the at least one support means may be extended by a predetermined distance from the reflecting surface of the main reflecting plate in a region outside the region in which the first feed horn is disposed.

The second feed horn may transmit or receive a signal of a frequency band different from a frequency band of the signal used in the first feed horn.

The second feed horn may have a prime focus type.

The structure in which the sub-reflecting plate and the second feed horn are integrated may be mechanically fastened to the at least one support means by a shaft, and may be rotatably moved in a predetermined direction with respect to the shaft as a center axis so that the sub-reflecting plate is oriented toward the main reflecting plate or the second feed horn is oriented toward the main reflecting plate.

Another aspect of the present invention provides an antenna for satellite communication having a structure for switching multiband signals, including: a main reflecting plate configured to be rotatable in a predetermined direction so as to be oriented in a direction in which a satellite is located; a first feed horn configured to be detachably installed in a region of an edge of the main reflecting plate; a sub-reflecting plate configured to be installed so as to be spaced apart from a reflecting surface of the main reflecting plate by a predetermined distance by at least one support means provided in a region of the main reflecting plate; and a second feed horn configured to be detachably installed on a side opposite to the reflecting surface of the sub-reflecting plate, wherein an installation position of the sub-reflecting plate is changeable.

The antenna for satellite communication may further include a driving means configured to change the installation position of the sub-reflecting plate between a first position and a second position in accordance with a control instruction of a user.

An installation position of the second feed horn may be accordingly changed in accordance with the installation position of the sub-reflecting plate when the installation position of the sub-reflecting plate is changed between the first position and the second position, the sub-reflecting plate may be oriented toward the first feed horn and the main reflecting plate when the sub-reflecting plate is located in the first position, and the second feed horn may be oriented toward the main reflecting plate when the sub-reflecting plate is located in the second position.

Advantageous Effects of Invention

According to a variety of embodiments of the present invention, weight of a feed horn that can be mounted in an antenna for satellite communication may be reduced, thereby simplifying a structure of the antenna.

Also, a plurality of feed horns may be provided without a user replacing or reinstalling the feed horn, and therefore a satellite signal band may be easily changed, thereby increasing convenience of the user.

Furthermore, focuses of a feed horn and a main reflecting plate may be accurately aligned by automatically controlling positions of a sub-reflecting plate and the feed horn by a driving means.

BRIEF DESCRIPTION OF DRAWINGS

FIG. 1 is a perspective view showing an antenna for satellite communication having a structure for switching multiband signals according to an embodiment of the present invention;

FIG. 2 is a view showing a satellite communication path in case a sub-reflecting plate according to an embodiment of the present invention is located in a first position;

FIG. 3 is a view showing a satellite communication path in case a sub-reflecting plate according to an embodiment of the present invention is located in a second position;

FIG. 4 is a view showing a process in which a sub-reflecting plate according to an embodiment of the present invention is moved between a first position and a second position;

FIG. 5 is a view exemplarily showing a structure of a first feed horn provided in a main reflecting plate of an antenna for satellite communication having a structure for switching multiband signals according to an embodiment of the present invention;

FIG. 6 is a view exemplarily showing an integrated structure constituted of a sub-reflecting plate and a second feed horn according to an embodiment of the present invention;

FIG. 7 is a view exemplarily showing a structure of the sub-reflecting plate provided in the integrated structure shown in FIG. 6; and FIG. 8 is a view exemplarily showing a structure of the second feed horn provided in the integrated structure shown in FIG. 6.

MODE FOR THE INVENTION

Hereinafter, exemplary embodiments of the present invention will be described in detail. However, the present invention is not limited to the exemplary embodiments disclosed below, but can be implemented in various forms. The following exemplary embodiments are described in order to enable those of ordinary skill in the art to embody and practice the invention.

FIG. 1 is a perspective view showing an antenna for satellite communication having a structure for switching multiband signals according to an embodiment of the present invention.

As shown in FIG. 1, an antenna system for satellite communication may include an antenna 100 for satellite communication, a rotation device 200, a support device 300, and a base device 400.

The antenna 100 for satellite communication having a structure for switching multiband signals according to an embodiment of the present invention may be installed on a motion body (not shown) by the base device 400.

In addition, the antenna 100 may be rotatably moved in a predetermined direction by the rotation device 200. The antenna 100 may be connected to the base device 400 through the support device 300 connected to the rotation device 200.

In this instance, the support device 300 may include a damper (not shown) for reducing the impact due to movement of the mobile body.

The present invention is characterized in that the antenna 100 has a structure for switching multiband signals. Accordingly, specific descriptions of the rotation device 200, the support device 300, and the base device 400 will be omitted. Such omissions are not intended to restrict or limit technical features of the present invention only to the antenna for satellite communication, and a person having ordinary skill in the art would have no difficulty in understanding the present invention despite such omissions, and therefore the description herein will focus on the antenna 100 for satellite communication.

The antenna 100 for satellite communication having the structure for switching multiband signals according to an embodiment of the present invention may be implemented in the form of a parabolic antenna. Alternatively, the antenna 100 may be implemented in the form of an offset type antenna.

The antenna 100 for satellite communication having the structure for switching multiband signals according to an embodiment of the present invention may include a plurality of feed horns so that communication may be performed with multiband signals.

The antenna 100 includes a structure for detachably mounting and switching the plurality of feed horns. Hereinafter, the structure for switching the plurality of feed horns will be described with reference to a separate drawing.

In FIG. 1, a case in which two feed horns are provided will be exemplarily described. A first feed horn 120 and a second feed horn 140 which are shown in FIG. 1 may perform communication with specific band signals in accordance with a predetermined design condition.

For example, the first feed horn 120 may be a feed horn for performing communication with low frequency band signals referred to as first band signals.

The second feed horn 140 may be a feed horn for performing communication with high frequency band signals referred to as second band signals.

The frequency band of the first feed horn 120 according to an embodiment of the present invention may be any one of a plurality of frequency bands for satellite communication, for example, L band, S band, C band, X band, Ku band, K band, Ka band, Q band, U band, V band, E band, W band, F band, and D band.

However, types of these frequency bands for satellite communication are merely examples. The frequency bands for satellite communication according to the present invention may include all of a variety of frequency band signals enabling communication with a satellite other than the above-described signal bands.

The present invention is characterized in that the first feed horn 120 and the second feed horn 140 can use mutually different frequency band signals.

The first feed horn 120 and the second feed horn 140 may perform communication with a satellite through high frequency band signals or low frequency band signals which enable satellite communication.

Accordingly, the second feed horn 140 may perform communication with frequency band signals different from frequency band signals used in the first feed horn 120. Such a plurality of feed horns 120 and 140 may be detachably provided on the main reflecting plate 110 or the sub-reflecting plate 130. When the plurality of feed horns 120 and 140 are mounted in the main reflecting plate 110 or the sub-reflecting plate 130, the plurality of feed horns 120 and 140 may form an integrated structure with the main reflecting plate 110 or the sub-reflecting plate 130.

Here, the integrated structure may refer to a structure in which the feed horn is mechanically fastened to the reflecting plate, and the feed horn is rotated by an external force or a position of the feed horn is changed together with the reflecting plate.

According to various embodiments of the present invention, a plurality of feed horns which are installed in the main reflecting plate 110 may be provided. In addition, the plurality of feed horns installed in the main reflecting plate 110 may be designed to have a structure capable of being switched.

A plurality of feed horns which are installed in the sub-reflecting plate 130 may be provided. The plurality of feed horns installed in the sub-reflecting plate 130 may be also designed to have a structure capable of being switched.

Here, the structure capable of being switched refers to a structure in which the feed horn is rotated with respect to a specific axis and therefore a position of the feed horn can be changed.

A case in which the antenna 100 for satellite communication having the structure for switching multiband signals according to the present invention includes two feed horns is merely an example, and thus the antenna 100 may include three or more feed horns.

However, for convenience of description, the description will focus on a case in which one feed horn is installed in the main reflecting plate 110 and two feed horns are installed in the sub-reflecting plate 130.

As shown in FIG. 1, the antenna 100 for satellite communication having the structure for switching multiband signals may include the main reflecting plate 110, a first feed horn 120, the sub-reflecting plate 130, and a second feed horn 140.

The main reflecting plate 110 may be rotated in a predetermined direction so as to be oriented toward a direction in which a satellite is located. For example, the main reflecting plate 110 may be rotated clockwise or counterclockwise about a Z-axis by a rotation device 200.

The main reflecting plate 110 may be rotated in a predetermined direction along X-axis or Y-axis by the rotation device 200. Accordingly, a position of a reflecting surface of the main reflecting plate 110 may be changed by the rotation device 200 so that the main reflecting plate 110 is oriented in the direction in which the satellite is located.

The first feed horn 120 may be installed in one region of the main reflecting plate 110. For example, when the antenna 100 for satellite communication is an offset type, the first feed horn 120 may be installed in an edge region of the main reflecting plate 110 so that a shadow region generated by the first feed horn 120 is minimized.

When the antenna 100 is a parabolic type, the first feed horn 120 may be provided at a center region of the main reflecting plate 110.

When the first feed horn 120 is larger than the second feed horn 140 in weight and size, it is more stable that the first feed horn 120 is mounted in the main reflecting plate 110.

The first feed horn 120 may be configured in such a manner as to pass through one region of the main reflecting plate 110.

A partial region of the first feed horn 120 may be exposed in a direction of the reflecting surface, and the remaining region thereof may be exposed in a direction opposite to the reflecting surface.

The sub-reflecting plate 130 may be disposed so as to be oriented toward the main reflecting plate 110 and/or the first feed horn 120 in a position spaced apart from the reflecting surface of the main reflecting plate 110 by a predetermined distance.

That is, the sub-reflecting plate 130 may be fixed on a position spaced further apart from a position in which the first feed horn 120 is exposed from the reflecting surface of the main reflecting plate 110 by at least one support means 150. For example, the at least one support means 150 may have a tripod shape. The three support axes of the tripod may be fixed in an edge region of the main reflecting plate 110. The sub-reflecting plate 130 may be rotatably fastened at a point at which the three support axes of the tripod converge.

Since the sub-reflecting plate 130 is positioned on the reflecting surface of the main reflecting plate 110, a shadow region of the sub-reflecting plate 130 may be generated. However, the sub-reflecting plate 130 may be designed in such a manner as to be disposed to face the first feed horn 120, and therefore the shadow region generated in the sub-reflecting plate 130 and the shadow region generated by the first feed horn 120 may overlap. Therefore, the shadow regions generated by the first feed horn 120 and the sub-reflecting plate 130 may be minimized.

In addition, a fastening housing 132 that can be fastened to the at least one support means 150 may be provided on an opposite side of the sub-reflecting plate 130. The fastening housing 132 may be mechanically fastened to the at least one support means 150 by at least one fastening means.

Such a fastening means may be implemented in various methods such as with screws, bolts, nuts, shafts, and the like. In particular, when the fastening housing 132 is fastened to the at least one support means 150 in a shaft method, the sub-reflecting plate 130 may be rotated with respect to the shaft in a predetermined direction.

That is, the sub-reflecting plate 130 is rotated with respect to the shaft, so that the sub-reflecting plate 130 may be located in a first position in which the reflecting surface 131 of the sub-reflecting plate 130 is oriented toward the main reflecting plate 110 and the first feed horn 120.

Alternatively, the sub-reflecting plate 130 is rotated with respect to the shaft, so that the sub-reflecting plate 130 may be located in a second position in which the reflecting surface 131 of the sub-reflecting plate 130 is not oriented toward the main reflecting plate 110 and the first feed horn 120.

When the sub-reflecting plate 130 is located in the position (first position) in which it is oriented toward the first feed horn 120, the sub-reflecting plate 130 re-reflects signals reflected by the main reflecting plate 110 to the first feed horn 120. Alternatively, the sub-reflecting plate 130 may reflect signals output from the first feed horn 120 to the main reflecting plate 110, and the main reflecting plate 110 may re-reflect the reflected signals to transmit the re-reflected signals to a satellite.

On the other hand, when the sub-reflecting plate 130 is located in the position (second position) in which it is not oriented toward the first feed horn 120, the reflecting surface of the sub-reflecting plate 130 is not oriented toward the main reflecting plate 110.

As described above, in order to change the position of the sub-reflecting plate 130, a driving means (not shown) for supplying a driving force to the sub-reflecting plate 130 may be further provided.

The second feed horn 140 may be detachably coupled to the housing 132 of the sub-reflecting plate 130. In this instance, the second feed horn 140 may form an integrated structure with the sub-reflecting plate 130. That is, the second feed horn 140 may be electrically separated from the sub-reflecting plate 130 but mechanically fastened to the sub-reflecting plate 130, and therefore the position of the second feed horn 140 may be accordingly changed when the position of the sub-reflecting plate 130 is changed. In this sense, the sub-reflecting plate 130 and the second feed horn 140 may form the integrated structure.

According to an embodiment of the present invention, the second feed horn 140 may be separated from the sub-reflecting plate 130.

Motions and position changes of the sub-reflecting plate 130 and the second feed horn 140 will be hereinafter described in further detail.

First, a case in which the sub-reflecting plate 130 is located in the first position will be described.

When located in the first position, the sub-reflecting plate 130 may be oriented toward the main reflecting plate 110 and the first feed horn 120.

When located in the second position, the sub-reflecting plate 130 may not be oriented toward the main reflecting plate 110 and the first feed horn 120.

That is, the sub-reflecting plate 130 and the second feed horn 140 may form an integrated structure, and may be moved together. However, directions in which center axes of the sub-reflecting plate 130 and the second feed horn 140 are oriented are different from each other, and therefore only one of the sub-reflecting plate 130 and the second feed horn 140 may be oriented toward the main reflecting plate 110 by a rotary motion.

In this manner, the sub-reflecting plate 130 and the second feed horn 140 may form a rotatable integrated structure, and the integrated structure may be automatically rotated by the driving means so that a position of the integrated structure may be changed.

The sub-reflecting plate 130 and the second feed horn 140 perform a rotary motion, centering around the fastening means that mutually fastens sub-reflecting plate 130 and the at least one support means 150, at the predetermined angle and in the predetermined direction.

The antenna 100 for satellite communication according to an embodiment of the present invention may simultaneously include a plurality of feed horns so as to perform communication with multiband signals.

The sub-reflecting plate 130 and the second feed horn 140 may form the integrated structure, and the position of the integrated structure may be come changeable. Accordingly, when the position of the integrated structure is changed, a frequency band may be automatically switched by changing the first feed horn 120 and the second feed horn 140.

Such an integrated structure may be rotated centering around the shaft fastened to the at least one support means. By rotating the integrated structure centering around the shaft in accordance with a control instruction of a user, the feed horn for performing communication with desired band signals may be easily changed.

According to an embodiment of the present invention, the driving means (not shown) may be used to provide a driving force for moving the sub-reflecting plate 130 and the second feed horn 140.

For example, such a driving means may be implemented as a linear motor. The linear motor may accurately control the position of the sub-reflecting plate 130 in accordance with a control instruction of the user.

Accordingly, in the antenna for satellite communication according to the present invention, the feed horn may be automatically changed by a user, and focuses of the feed horn and the reflecting plate may be accurately aligned.

More specifically, the linear motor according to an embodiment of the present invention may adjust the sub-reflecting plate 130 to be located in a desired position in accordance with the control instruction of the user.

That is, the linear motor may be mechanically fastened to the sub-reflecting plate 130, and driven by a control signal in response to the control instruction of the user, thereby supplying a driving force for properly moving the sub-reflecting plate 130.

According to another embodiment of the present invention, the driving means may be implemented by various types other than the linear motor such as an electric motor, a belt driving means, a cam driving means, and the like which can convert a rotary motion into a linear motion.

FIG. 2 is a view showing a satellite communication path in case a sub-reflecting plate according to an embodiment of the present invention is located in a first position.

Referring to FIG. 2, the antenna 100 for satellite communication may receive signals from a satellite through the sub-reflecting plate 130 and the first feed horn 120, or transmit the signals to the satellite (first communication mode).

First, a process of receiving the signals from the satellite in the first communication mode will be described as follows:

The rotation device 200 may detect a direction in which the satellite is located, and rotate so that a reflecting surface of the main reflecting plate 110 can be oriented in the direction in which the satellite is located.

When the main reflecting plate 110 is located in a position in which it is oriented toward the satellite, signals transmitted from the satellite may be received, and the received signals may be reflected to the sub-reflecting plate 130.

Since the sub-reflecting plate 130 is oriented toward the main reflecting plate 110, the signals reflected from the main reflecting plate 110 may be re-reflected to the first feed horn 120.

The first feed horn 120 may finally receive the signals reflected by the sub-reflecting plate 130.

In this instance, the first feed horn 120 may perform communication with predetermined frequency band signals.

In FIG. 2, a state in which the sub-reflecting plate 130 is located in a first position is shown.

When the sub-reflecting plate 130 is located in the first position, the sub-reflecting plate 130 is located in a position in which it is oriented toward the main reflecting plate 110 and the first feed horn 120.

On the other hand, the second feed horn 140 is located in a position in which it is not oriented toward the main reflecting plate 110.

Thus, the antenna 100 for satellite communication may be operated in the first communication mode capable of performing satellite communication through the first feed horn 120.

FIG. 3 is a view showing a satellite communication path in case a sub-reflecting plate according to an embodiment of the present invention is located in a second position.

Referring to FIG. 3, the antenna 100 for satellite communication may receive signals from a satellite through the main reflecting plate 110 and the second feed horn 140, or transmit the signals to the satellite (second communication mode).

First, a process of receiving the signals from the satellite will be described as follows:

The rotation device 200 may detect a direction in which the satellite is located, and rotate the main reflecting plate 110 so that a reflecting surface of the main reflecting plate 110 is oriented in the direction in which the satellite is located.

When the main reflecting plate 110 is located in a position in which it is oriented toward the satellite, signals transmitted from the satellite may be received, and then the received signals may be reflected to the second feed horn 140.

The second feed horn may finally receive the signals reflected by the main reflecting plate 110.

In this instance, the second feed horn 140 may perform communication with frequency band signals different from the frequency band signals usable by the first feed horn 120.

In FIG. 3, a state in which the sub-reflecting plate 130 is located in a second position is shown. That is, when the sub-reflecting plate 130 is located in the second position, the second feed horn 140 may be located in a position in which it is oriented toward the main reflecting plate 110. On the other hand, the sub-reflecting plate 130 may be located in a position in which it is not oriented toward the main reflecting plate 110. Accordingly, the antenna 100 for satellite communication may be operated in a second communication mode capable of performing satellite communication through the second feed horn 140.

According to an embodiment of the present invention, the sub-reflecting plate 130 and the second feed horn 140 are mechanically fastened, thereby forming an integrated structure. Thus, when a position of the sub-reflecting plate 130 is changed, a position of the second feed horn 140 may be changed accordingly.

Hereinafter, a process in which the antenna 100 for satellite communication is switched to a first communication mode or a second communication mode in accordance with the position of the sub-reflecting plate 130 will be described with reference to drawings.

FIG. 4 is a view showing a process in which a sub-reflecting plate according to an embodiment of the present invention is moved between a first position and a second position.

FIG. 4 is obtained by enlarging a partial region in which the first feed horn 120, the sub-reflecting plate 130, the second feed horn 140, and the at least one support means 150 are shown.

Referring to FIG. 4, a position of the sub-reflecting plate 130 for performing communication with a satellite through the first feed horn 120 will be described.

When a center axis of the sub-reflecting plate 130 is located in the first position P1, the sub-reflecting plate 130 may receive satellite signals reflected from the main reflecting plate 110, and reflect the received satellite signals to the first feed horn 120.

In particular, the sub-reflecting plate 130 may be oriented toward the first feed horn 120 so as to be aligned with a focus position of the first feed horn 120 installed in a region of the main reflecting plate 110. Alternatively, the sub-reflecting plate 130 may not be oriented toward the first feed horn 120 so as to deviate from the focus position of the first feed horn 120.

When the center axis of the sub-reflecting plate 130 is located in the first position P1, a focus of the sub-reflecting plate 130 and a focus of the first feed horn 120 may be aligned. Specifically, focus $F_1$ of the main reflecting plate 110 and first focus $f_1$ of the sub-reflecting plate may be aligned with each other, and second focus $f_2$ of the sub-reflecting plate 130 and focus of first front horn 121 of the first feed horn 120 may be aligned with each other.

In this case, the first feed horn 120 may receive satellite signals from the main reflecting plate 110 via the sub-reflecting plate 130, or transmit the satellite signals to the main reflecting plate 110.

Next, a position of the second feed horn 140 for performing communication with a satellite through the second feed horn 140 will be described.

When the center axis of the sub-reflecting plate 130 is located in the second position P2, the sub-reflecting plate 130 may not be oriented toward the main reflecting plate 110.

On the other hand, a center axis of the second feed horn 140 that forms a predetermined angle with the center axis of the sub-reflecting plate 130 is oriented toward the main reflecting plate 110.

Since the second feed horn 140 is oriented toward the main reflecting plate 110, the focus $F_1$ of the main reflecting plate 110 and focus f" of the second feed horn 140 are aligned with each other.

Accordingly, the second feed horn 140 may receive satellite signals from the main reflecting plate 110 or transmit the satellite signals to the main reflecting plate 110.

According to an embodiment of the present invention, although not shown in FIG. 4, a driving means (not shown) may provide a rotational force for driving the integrated structure. The driving means may be implemented by a means capable of supplying a rotational force in various methods such as a linear motor, a belt driving means, a cam driving means, and the like.

Such a driving means may accurately control a position of the integrated structure in accordance with a user control instruction.

Accordingly, according to an embodiment of the present invention, when a user inputs a control instruction for changing from the first feed horn 120 to the second feed horn 140, a control signal in accordance with the control instruction is transmitted to a driving motor. The driving motor may change current positions of the sub-reflecting plate 130 and the second feed horn 140 into desired positions based on the control signal. At the same time, the driving motor may accurately perform position adjustment so that the sub-reflecting plate 130 or the second feed horn 140 may be aligned with the focus of the main reflecting plate 110.

FIG. 5 is a view exemplarily showing a structure of a first feed horn provided in a main reflecting plate of an antenna for satellite communication having a structure for switching multiband signals according to an embodiment of the present invention.

Referring to FIG. 5, the first feed horn 120 may include first front horn 121, polarizer 122, adaptor 123, radar filter 124, and first band signal LNB 125.

The first front horn 121 may receive or transmit signals from or to a satellite.

The polarizer 122 may be connected to the first front horn 121, and transmit and receive linear polarization and circular polarization of satellite signals.

The adaptor 123 may be connected to the polarizer 122 to enable multiband feed of the satellite signals.

The radar filter 124 may be connected to the adaptor 123 to filter noise included in the transmitted and received signals.

The first band signal LNB 125 may convert a satellite frequency of a first band into an intermediate frequency that can be recognized by a receiver.

FIG. 6 is a view exemplarily showing an integrated structure constituted of a sub-reflecting plate and a second feed horn according to an embodiment of the present invention.

Referring to FIG. 6, fastening housing 132 may be provided on a side opposite to the reflecting surface 131 of the sub-reflecting plate 130.

In the fastening housing 132, a plurality of fastening means 133 and 134 may be provided. The fastening means 133 and 134 may be implemented in a variety of fastening methods such as screws, bolts, nuts, shafts, and the like.

In the fastening housing 132 shown in FIG. 6, the first fastening means 133 may mechanically connect at least one support means 150 and the housing 132 of the sub-reflecting plate 130.

In this instance, the first fastening means 133 may act as a shaft axis for rotating the sub-reflecting plate 130 with respect to X-axis in a direction a.

The second fastening means 134 may mechanically connect the housing 132 of the sub-reflecting plate 130 and a driving means (not shown). In this instance, the driving means may provide a driving force for rotating the sub-reflecting plate 130 in the direction a to the sub-reflecting plate 130 through the second fastening means 134. For example, when the driving means is implemented by a linear motor, the driving means may convert a rotary motion into a linear motion, and therefore the sub-reflecting plate 130 may be rotated in the direction a or the opposite direction.

As shown in FIG. 6, an angle between a normal line direction (Y-axis direction) of the reflecting surface 131 of the sub-reflecting plate 130 and a direction (Z-axis direction) of a center axis of the second feed horn 140 may be a predetermined angle.

For example, the angle between the normal line direction (Y-axis direction) and the direction (Z-axis direction) of the center axis may be designed to be 90 degrees. However, the normal line direction of the sub-reflecting plate 130 and the direction of the center axis of the second feed horn 140 may be designed so as to form an angle larger than 90 degrees. That is, the structure in which the sub-reflecting plate 130 and the second feed horn 140 are integrated may be implemented in various forms at need.

In FIG. 6, an example in which the sub-reflecting plate 130 and the second feed horn 140 are disposed at an angle of approximately 60 degrees is shown. This angle is not intended to limit the form of the structure in which the sub-reflecting plate 130 and the second feed horn 140 are integrated, and is merely an example.

In the present invention, specific descriptions of various other forms of the structure will be omitted. However, various examples of the structure in which the sub-reflecting plate 130 and the second feed horn 140 are integrated may be carried out in various ways by those skilled in the art.

The present invention includes various modified examples of forming the structure in which the sub-reflecting plate 130 and the second feed horn 140 are integrated.

As shown in FIG. 6, the sub-reflecting plate 130 and the second feed horn 140 may form an integrated structure. Accordingly, when a position of the sub-reflecting plate 130 is changed, a position of the second feed horn 140 may be changed accordingly. For example, when the sub-reflecting plate 130 is rotated 30 degrees in a direction a that is the predetermined direction shown in FIG. 6, the second feed horn 140 may be rotated 30 degrees in the direction a in accordance with the motion of the sub-reflecting plate 130.

In the antenna 100 according to an embodiment of the present invention, the first feed horn 120 may be formed in the main reflecting plate 110, and the second feed horn 140 may be integrally formed with the sub-reflecting plate 130, and therefore the first feed horn 120 or the second feed horn 140 may be automatically changed by adjusting a position of the sub-reflecting plate 130.

FIG. 7 is a view exemplarily showing a structure of the sub-reflecting plate provided in the integrated structure shown in FIG. 6.

Referring to FIG. 7, the sub-reflecting plate 130 may include a reflecting surface 131 and a fastening housing 132.

The reflecting surface 131 may reflect, to the first feed horn 120, satellite signals reflected from the main reflecting plate 110. Alternatively, the reflecting surface 131 may reflect, to the main reflecting plate 110, satellite signals transmitted from the first feed horn 120.

The fastening housing 132 may be integrally formed with the reflecting surface 131 on a side opposite to the reflecting surface 131.

The fastening housing 132 may have a hollow internal space so that the second feed horn 140 can be inserted into the hollow internal space.

The fastening housing 132 may include at least one fastening means for mechanically fastening the sub-reflecting plate 130 with the at least one support means 150.

In addition, the fastening housing 132 may be mechanically fastened to a driving motor (not shown) so that the sub-reflecting plate 130 is rotatably moved, thereby receiving a driving force from the driving motor.

FIG. 8 is a view exemplarily showing a structure of the second feed horn provided in the integrated structure shown in FIG. 6.

Referring to FIG. 8, the second feed horn 140 may include a second front horn 141, a filter 142, and a second band signal LNB 143.

The second front horn 141 may receive or transmit satellite signals from or to a satellite.

The filter 142 may be provided between a rear end of the second front horn 141 and a front end of the second band signal LNB 143, and may remove noise included in a band other than a desired bandwidth.

The second band signal LNB 143 may convert a satellite frequency of second band signals into an intermediate frequency. In this instance, the second band is a frequency band different from the first band.

As described above, according to the various embodiments of the present invention, at least one detachable feed horn may be provided in the main reflecting plate 110. A position of the at least one feed horn may be changed.

In addition, at least one detachable feed horn may be provided in the sub-reflecting plate 130. In this instance, the sub-reflecting plate 130 and the at least one detachable feed horn may be integrally formed, and may be switched.

In addition, a user may accurately and easily change a feed horn by providing an antenna for satellite communication having a structure for switching multiband signals, thereby switching the multiband signals.

While the invention has been shown and described with reference to certain exemplary embodiments thereof, it will be understood by those skilled in the art that various other changes in form and details may be made without departing from the spirit and scope of the invention as defined by the appended claims.

INDUSTRIAL APPLICABILITY

The present invention can be applied to an antenna for satellite communication.

The invention claimed is:

1. An antenna for satellite communication having a structure for switching multiband signals, which is installed in a mobile body, the antenna for satellite communication comprising:

a main reflecting plate configured to be rotatable in a predetermined direction so as to detect a satellite signal;

a sub-reflecting plate configured to be installed so as to be spaced apart from the main reflecting plate by a predetermined distance by at least one support means installed in an edge region of a reflecting surface of the main reflecting plate;

a first feed horn configured to transmit a first band signal to a satellite through the main reflecting plate via the sub-reflecting plate or receive the first hand signal from the satellite, the first feed horn comprising a first front horn exposed into the reflecting surface through the edge region of the main reflecting plate, and a remaining portion of the first feed horn not penetrating the edge region of the main reflecting plate, the remaining portion of the first feed horn combined with the rear surface of the main reflecting plate; and a second feed horn configured to be electrically separated from the sub-reflecting plate, the second feed horn forming a structure integrated with the sub-reflecting plate, and configured to transmit a second hand signal to the satellite through the main reflecting plate or receive the second hand signal from the satellite, wherein the first feed horn is supported by the main reflecting plate, wherein the first hand signal has lower frequency than the second band signal, and wherein the structure in which the sub-reflecting plate and the second feed horn are integrated is movable so that the sub-reflecting plate or the second feed horn is oriented toward the main reflecting plate or the first feed horn.

2. The antenna for satellite communication of claim 1, further comprising:

a driving means configured to be driven in accordance with a control instruction of a user and drive the sub-reflecting plate or the second feed horn to be oriented toward the main reflecting plate.

3. The antenna for satellite communication of claim 1, wherein the structure in which the sub-reflecting plate and the second feed horn are integrated is separated into the sub-reflecting plate and the second feed horn, and an angle between a normal line direction of the reflecting surface of the sub-reflecting plate and a direction of a center axis of the second feed horn is a predetermined angle.

4. The antenna for satellite communication of claim 1, wherein the first feed horn transmits or receives a signal of at least one frequency band among a plurality of frequency bands available for satellite communication.

5. The antenna for satellite communication of claim 1, wherein the first feed horn is configured in a Gregorian type.

6. The antenna for satellite communication of claim 1, wherein the first feed horn is disposed in a region of the main reflecting plate, and the at least one support means is extended by a predetermined distance from the reflecting surface of the main reflecting plate in a region outside the region in which the first feed horn is disposed.

7. The antenna for satellite communication of claim 1, wherein the second feed horn transmits or receives a signal of a frequency band different from a frequency band of the signal used in the first feed horn.

8. The antenna for satellite communication of claim 1, wherein the second feed horn is configured in a prime focus type.

9. The antenna for satellite communication of claim 1, wherein the structure in which the sub-reflecting plate and the second feed horn are integrated is mechanically fastened to the at least one support means by a shaft, and is rotatably moved in a predetermined direction with respect to the shaft as a center axis so that the sub-reflecting plate is oriented toward the main reflecting plate or the second feed horn is oriented toward the main reflecting plate.

* * * * *